United States Patent [19]

Yasuoka

[11] 4,399,341

[45] Aug. 16, 1983

[54] MICROWAVE HEATING APPARATUS

[75] Inventor: Yoshio Yasuoka, Hirakata, Japan

[73] Assignee: Sanyo Electric Co., Ltd., Moriguchi, Japan

[21] Appl. No.: 287,054

[22] Filed: Jul. 27, 1981

[30] Foreign Application Priority Data

| | | | |
|---|---|---|---|
| Aug. 6, 1980 | [JP] | Japan | 55-108644 |
| Nov. 19, 1980 | [JP] | Japan | 55-163751 |
| Dec. 16, 1980 | [JP] | Japan | 55-178332 |
| Apr. 3, 1981 | [JP] | Japan | 56-50798 |
| Apr. 3, 1981 | [JP] | Japan | 56-50799 |

[51] Int. Cl.[3] ..... H05B 6/64; H01P 3/08

[52] U.S. Cl. ..... 219/10.55 R; 333/238; 333/246; 355/3 FU; 219/10.55 F; 219/10.55 A

[58] Field of Search ..... 219/10.55 R, 10.55 A, 219/10.55 D, 10.55 F; 333/238, 239, 242, 246; 355/3 FU

[56] References Cited

U.S. PATENT DOCUMENTS

| | | | |
|---|---|---|---|
| 3,048,686 | 8/1962 | Schmidt | 219/10.55 A |
| 3,290,516 | 12/1966 | Nishizawa | 333/238 |
| 3,419,813 | 12/1968 | Kamnitsis | 333/238 |
| 3,654,573 | 4/1972 | Graham | 333/238 |
| 4,032,865 | 6/1977 | Harp | 333/242 |
| 4,269,581 | 5/1981 | Ury | 219/10.55 F |

FOREIGN PATENT DOCUMENTS

| | | | |
|---|---|---|---|
| 800698 | 12/1968 | Canada | 219/10.55 D |
| 2645765 | 4/1978 | Fed. Rep. of Germany | 355/3 FU |
| 1135238 | 12/1968 | United Kingdom | 219/10.55 A |
| 1384034 | 2/1975 | United Kingdom | 333/238 |

OTHER PUBLICATIONS

Adams, John P., "Microstrip for Microwave Circuitry", *Radio-Electronic Engineering*, 4/54, pp. 14–15, 40, 42.

Bland, G. F., "Coax to Stripline Transition", *IBM Technical Disclosure Bulletin*, vol. 3, No. 4, Sep. 1960, pp. 22–23.

*Primary Examiner*—B. A. Reynolds
*Assistant Examiner*—Teresa J. Walberg
*Attorney, Agent, or Firm*—Darby & Darby

[57] ABSTRACT

A microwave heating apparatus comprising a stripline receiving a supply of a microwave from a coaxial line. The stripline comprises a center conductor formed on a dielectric base plate, the rear surface of which is formed with a ground conductor, wherein a plurality of slits are arranged distributed in the propagating direction of the microwave on the center conductor or ground conductor, thereby to form a ladder circuit portion. A material being heated such as a paper sheet is transferred on the ladder circuit portion, while the same is heated by the microwave leaked through the slits of the center conductor or the ground conductor.

25 Claims, 20 Drawing Figures

FIG.13
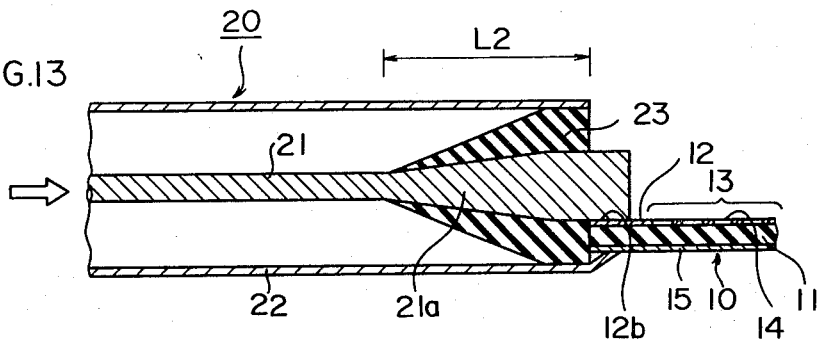
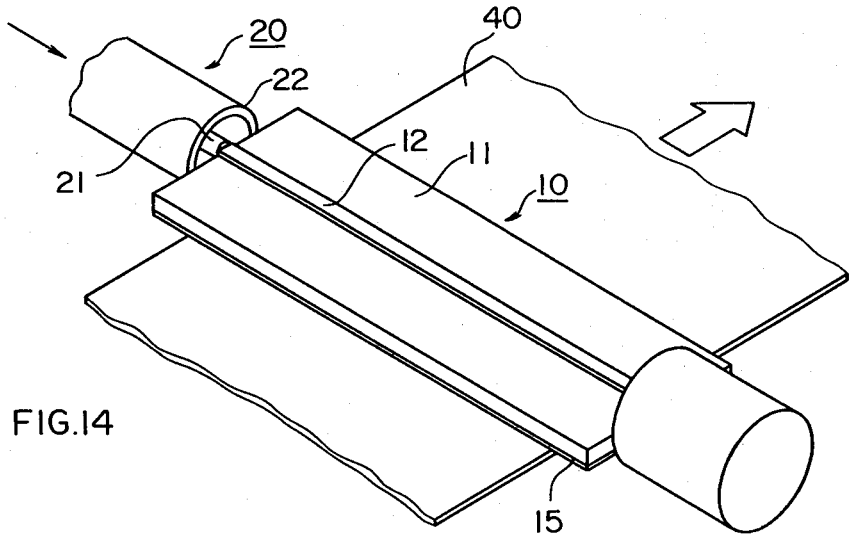
FIG.14
FIG.15
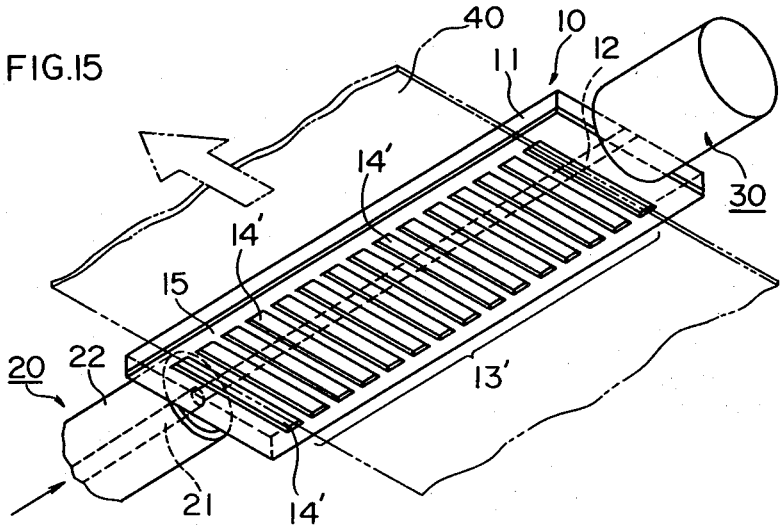

MICROWAVE HEATING APPARATUS

BACKGROUND OF THE INVENTION

1. Field of the Invention

The present invention generally relates to a microwave heating apparatus. More specifically, the present invention relates to a microwave heating apparatus adapted for uniformly heating a sheet-like material such as a paper sheet and the surfaces of other types of a material being heated.

2. Description of the Prior Art

Conventionally it has been well-known that a material to be heated may be heated by a microwave. However, in heating a material having a large surface area as compared with the volume thereof, such as a paper sheet, by the use of a conventional microwave heating apparatus, the heating efficiency is decreased and hence the electric field strength of the microwave need be increased. Accordingly, it was not easily possible to effectively and uniformly heat a sheet-like material, such as a paper sheet, by the use of a conventional microwave heating apparatus.

Of late, a microwave heating apparatus adapted for heating a sheet-like material being heated using a rectangular waveguide has been proposed and is disclosed in Japanese Patent Publication No. 873/1980, for example. FIG. 1 is a perspective view showing a portion of one example of a conventional microwave heating apparatus which constitutes the background of the invention. The conventional microwave heating apparatus shown comprises a rectangular waveguide 1, having leakage openings 2 formed on the top surface thereof. When microwaves of 2450 MHz, for example, are supplied to the rectangular waveguide 1, the microwaves leak through the openings 2. Therefore, a sheet-like material being heated, such as a paper sheet, being transferred close to the waveguide 1 is heated with the leaked microwaves. According to this conventional approach, it is possible to uniformly heat a sheet-like material or the surface of a material being heated having a given thickness.

However, the FIG. 1 conventional approach still involves the shortcomings to be solved set forth in the following. More specifically, the size of a rectangular waveguide shown in FIG. 1 depends on the cut-off frequency and mode and, assuming that the frequency used is selected to be 2450 MHz, as described above, the internal geometry must be 109.2 mm×54.6 mm. Accordingly, a microwave heating apparatus employing a rectangular waveguide as shown in FIG. 1 has a large volume. On the other hand, it is also well-known that a microwave heating apparatus can be utilized to fuse a toner in an electrophotographic machine. However, in the light of a recent demand for a small sized or compact electrophotographic machines, incorporation of such microwave heating apparatus employing a rectangular waveguide having a large volume as described above in such electrophotographic machine makes it impossible to meet such demand for small sized or compact implementation.

SUMMARY OF THE INVENTION

Briefly described, the present invention comprises a microwave heating apparatus comprising a microstripline having a center conductor and at least one ground conductor, wherein a ladder circuit is formed on the center conductor or the ground conductor, the microstripline being supplied with microwaves, whereby a material being heated, such as a sheet-like material or the surface of a material having a given thickness, placed on or traveled along the ladder circuit portion of the microstripline, is uniformly heated.

According to the present invention, a rectangular waveguide having a large volume conventionally employed can be dispensed with. Therefore, a microwave heating apparatus of a very small size as compared with a conventional one is provided. Therefore, the microwave heating apparatus of the present invention can be advantageously utilized as a toner fixing apparatus of an electrophotographic machine, for example. However, it is a matter of course that the microwave heating apparatus, according to the present invention can be widely utilized in a case where a sheetlike material or the surface of a material being heated having a given thickness is uniformly heated. Furthermore, employment of a microstripline in lieu of a rectangular waveguide considerably reduces the material cost and the manufacturing cost as compared with those of the conventional one.

In a preferred embodiment of the present invention, a coaxial line is utilized to supply microwaves to a microstripline. The coaxial line comprises an inner conductor and an outer conductor and the center conductor or the ground conductor of the microstripline is connected to the center conductor of the coaxial line while the ground conductor or the center conductor of the microstripline is connected to the outer conductor of the coaxial line. Means for achieving impedance matching therebetween is also provided at at least one of the microstripline and the coaxial line.

In order to achieve impedance matching on the part of the microstripline, a preferred embodiment of the present invention is adapted such that the width of the center conductor or the ground conductor at a junction of the microstripline and the coaxial line is made narrower than the width of the ladder circuit portion and more preferably the width of the center conductor or the ground conductor of the microstripline is tapered to be gradually narrowed toward the coaxial line. According to the above described preferred embodiment of the present invention, impedance matching of the characteristic impedances of the microstripline and the coaxial line can be readily achieved, whereby microwaves can be effectively transferred through the junction of both the microstripline and the coaxial line.

In the case where impedance matching is achieved on the part of the coaxial line, a dielectric member having a predetermined dielectric constant is mounted at the portion for coupling to the microstripline and between the outer conductor and the inner conductor of the coaxial line. The length of the dielectric material is preferably selected as $\frac{1}{4}$ of the effective wavelength of the microwave being utilized. By thus inserting a dielectric material between the inner conductor and the outer conductor of the coaxial line, the necessity of an increased length of the microstripline is eliminated through impedance matching on the part of the microstripline and hence impedance matching of the characteristic impedances of both the microstripline and the coaxial line can be readily achieved. In addition, formation of the inner conductor of the coaxial line in a tapered form to be gradually wider toward the microstripline prevents a spark from undesirably occurring between the inner conductor and the outer conductor as a function of the dielectric material.

By selecting the end surface of the dielectric material inserted between the inner conductor and the outer conductor of the coaxial line opposite to the microstripline to intersect at an acute angle with respect to the axis of the coaxial line, reflection of the microwave from the dielectric material is prevented and hence the microwave is more effectively transferred.

In another preferred embodiment of the present invention, a microstripline is housed in a heating chamber. The chamber comprises an inlet for entry of a material being heated into the inside thereof and an outlet for discharge of the same therefrom. A plurality of dielectric resonators of the TE mode are also provided in the heating chamber associated with the inlet and/or the outlet for the purpose of preventing leakage of a microwave. The resonance frequency of the dielectric resonators is selected in association with the frequency of the microwave leakage which is to be prevented. Thus, by employing the dielectric resonators for the purpose of preventing leakage of microwaves, a leakage preventing means can be implemented in an extremely small size as compared with a case where a so-called choke cavity is employed for the same purpose.

Accordingly, a principal object of the present invention is to provide a microwave heating apparatus of a small size and an inexpensive cost.

One aspect of the present invention resides in the provision of a microwave heating apparatus employing a microstripline having a ladder circuit portion formed at a portion of a center conductor or a ground conductor.

Another aspect of the present invention resides in an arrangement for achieving impedance matching between a coaxial line and a microstripline for supplying a microwave to a microstripline.

A further aspect of the present invention resides in a structure for preventing leakage of microwaves from a heating chamber.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 7 to 9 are sectional views for explaining an approach for adjusting the characteristic impedance on the part of the coaxial line, wherein FIGS. 8 and 9 are sectional views taken along the lines VIII—VIII and IX—XI in FIG. 7;

FIG. 13 is a sectional view showning a modification of the FIG. 11 embodiment;

FIGS. 14 and 15 are perspective views showing still a further embodiment of the present invention, wherein FIG. 14 is a top view and FIG. 15 is a bottom view;

FIGS. 16 to 18 are views showing a preferred embodiment of the present invention, wherein FIG. 16 is a sectional view, FIG. 17 is a plan view and FIG. 18 is a perspective view.

DESCRIPTION OF THE PREFERRED EMBODIMENTS

Figure 1:
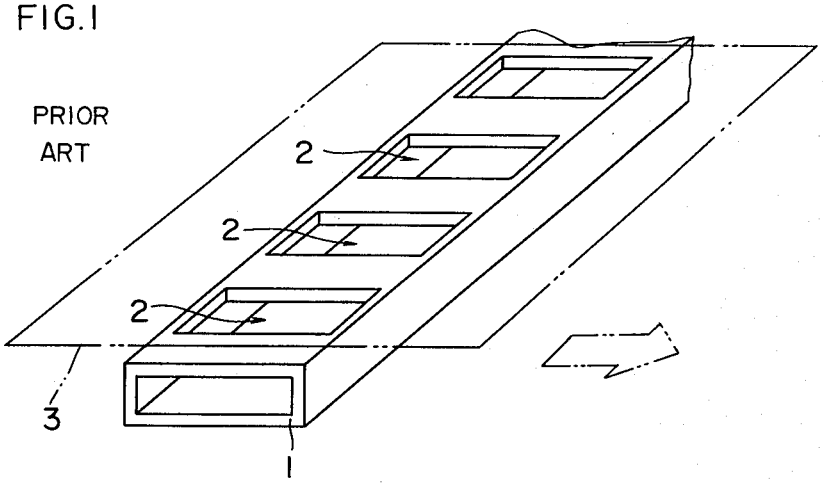
FIG.1 PRIOR ART
FIG. 1 is a perspective view showing one example of a conventional microwave heating apparatus which constitutes the background of the invention.
Figure 2:
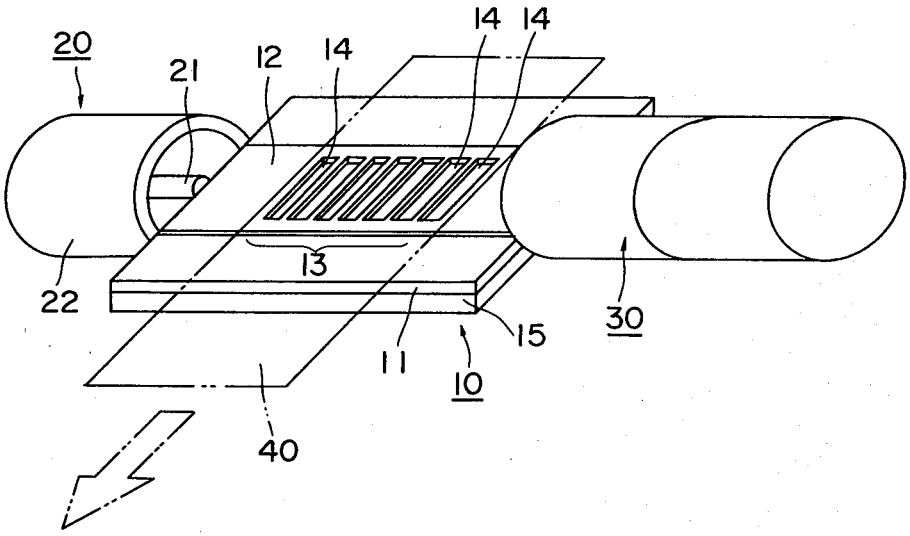
FIG. 2 is a perspective view showing one embodiment of the present invention.

FIG. 2 is a perspective view showing one embodiment of the present invention. The embodiment shown comprises a microstripline 10, a coaxial line 20 for supplying microwaves to the microstripline 10, and a dummy load 30. The microstripline 10 comprises a dielectric base plate 11 made of ceramic of alumina, for example, and a center conductor 12 is formed on the surface of the dielectric base plate 11. The center conductor 12 is formed of an electrically good conductive material, such as silver, and a ladder circuit portion 13 is formed in the part of the center conductor 12 in the length direction. The ladder circuit portion 13 comprises a plurality of leakage openings or slits 14 arranged in the length direction, i.e. the propagating direction of a microwave. The microstripline 10 further comprises a ground plane or ground conductor 15 made of silver or copper, for example, formed on the rear surface of the dielectric base plate 11 so as to be adhered thereto. The coaxial line 20 comprises an inner conductor 21 and an outer conductor 22 and the inner conductor 21 is connected to the center conductor 20 of the microstripline 10 and the outer conductor 22 is connected to the ground conductor 15. Alternatively, the center conductor 12 of the microstripline 10 and the outer conductor 22 of the coaxial line 20 may be connected and the ground conductor 15 and the inner conductor 21 may be connected, because an electric field being applied by the microwave is an alternating electric field. More specifically, there is no restriction to the polarity between the inner conductor 21 and the outer conductor 22 of the coaxial line 20 and between the center conductor 12 and the ground conductor 15 of the microstripline 10, respectively. A microwave oscillator of such as a magnetron, not shown, is provided at the input side, i.e. at the left side as viewed in FIG. 2, of the coaxial line 20, so that the coaxial line 20 is supplied with microwaves from the microwave oscillator to supply the same to the microstripline 10. A dummy load 30 is connected to the side opposite to the input side of the microwave of the microstripline 10. The dummy load 30 is aimed to absorb and consume microwaves not consumed by the ladder circuit portion 13, thereby to protect the microwave oscillator. Meanwhile, the length of the leakage openings or slits 14, i.e. the length in the direction intersecting the propagating direction of the microwave is selected to be slightly shorter than a half of the effective wavelength being utilized.

Microwaves are supplied to the microstripline 10 through the coaxial line 20 upon energization of the microwave oscillator, not shown, in the above described structure. A portion of the supplied microwaves are leaked through the respective slits 14 at the ladder circuit portion 13 formed in the center conductor 12. Accordingly, a sheetlike material being heated 40 such as a paper sheet placed on the ladder circuit portion 13 is heated by the leaked microwaves. Meanwhile, by providing a transfer means such as a conveyor or a roller, not shown, such that the material being heated 40 is in succession transferred in the arrow direction, the material being heated 40 is in succession and continually heated.

Figure 3:
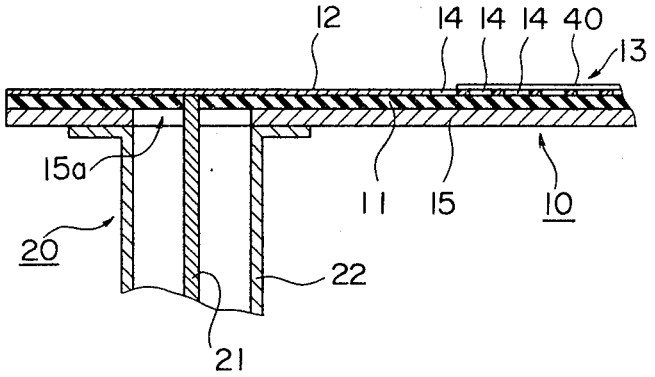
FIG. 3 is a sectional view showing a modification of the FIG. 2 embodiment.

FIG. 3 is a sectional view showing a modification of the FIG. 2 embodiment. In the FIG. 3 embodiment, the microstripline 10 and the coaxial line 20 are connected at a right angle. An opening 15*a* is formed at the ground conductor 15 of the microstripline 10. The inner conductor 21 of the coaxial line 20 is connected to the center conductor 12 of the microstripline 10 through the opening 15*a*. The outer conductor 22 of the coaxial line 20 is connected to the ground conductor 15 of the microstripline 10 by means of a flange portion, for example. Thus, the microstripline 10 and the coaxial line 20 need not be necessarily connected in a coplanar manner, as shown in FIG. 2, but both may be connected in an orthogonal manner. Meanwhile, the above described connection opening 15*a* is preferably formed in the same diameter as the inner diameter of the outer conductor 22 of the coaxial line 20.

Since the present invention employs the microstripline 10 having the ladder circuit portion 13, the same can be implemented with inexpensive cost and small size as compared with a conventional microwave heater employing a waveguide. Since an electric field is concentratedly formed by means of the above described ladder circuit portion, a material being heated 40 of a sheet-like form such as a paper sheet can be effectively heated.

Figure 4:
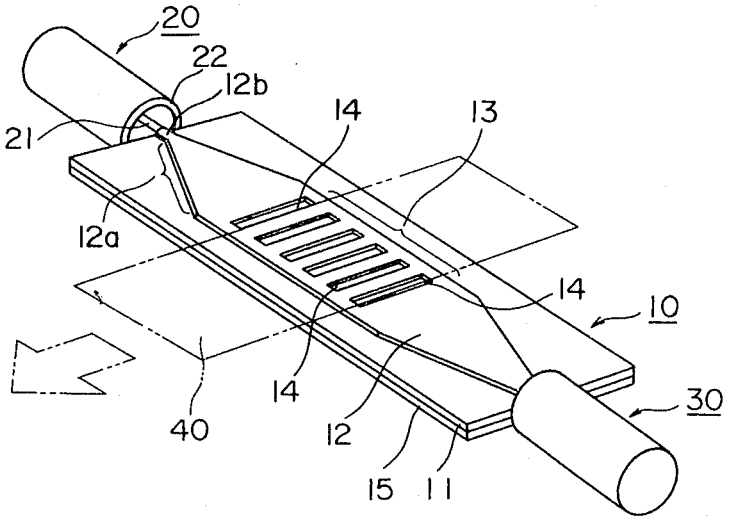
FIG. 4 is a perspective view showing another embodiment of the present invention.

FIG. 4 is a perspective view showing another embodiment of the present invention. In comparison with the FIG. 2 embodiment, the embodiment shown is characterized by a means for achieving impedance matching between the microstripline 10 and the coaxial 20. The characteristic impedance of the coaxial line 20 is approximately expressed by the following equation (1).

$$Zo = \frac{138}{\sqrt{\epsilon_r}} \log \frac{b}{a} \tag{1}$$

where $\epsilon_r$ is a relative dielectric constant of a medium between the inner conductor and the outer conductor, a is a diameter of the inner conductor, and b is an inner diameter of the outer conductor. The characteristic impedance of the coaxial line 20 is a function of the diameter a of the inner conductor 21 and inner diameter b of the outer conductor 22 and usually about 50Ω. Too small a characteristic impedance increases only the conductor resistance in supplying a microwave power.

On the other hand, the characteristic impedance of the microstripline is approximately expressed by the following equation (2).

$$Zo = \frac{10^4}{3\sqrt{\epsilon_r}\left\{7 + 8.83\left(\frac{c}{h}\right)\right\}} \tag{2}$$

where $\epsilon_r$ is a relative dielectric constant of the dielectric base plate 11, h is a thickness of the dielectric base plate 11, and c is a width of the center conductor, i.e. the length in the direction orthogonal to the microwave propagating direction. Thus, the characteristic impedance of the microstripline 10 is increased when the thickness h of the base plate 11 is increased or the width c of the center conductor 12 is decreased, assuming that the dielectric constant of the dielectric base plate 11 is constant. Assuming that alumina is employed as a material of the dielectric base plate 11, the dielectric constant is "9". Assuming that the thickness h of the dielectric base plate 11 and the width of the center conductor are 2 mm, respectively, the characteristic impedance thereof is approximately 50Ω, which means that impedance matching with the above described coaxial line 20 is attained. However, the present invention employs the ladder circuit portion 13 having a wide width as the center conductor. The length of the slits in the ladder circuit portion 13 is selected to be slightly shorter than a half of the effective wavelength of the microwave being employed, as described previously. Accordingly, assuming that the frequency of the microwaves being employed is 2450 MHz, for example, the width of the center conductor 12 in the ladder circuit portion 13 must be at least 20 mm. Accordingly, the characteristic impedance of the microstripline 10 at the ladder circuit portion 13 becomes extremely small as compared with other portion without the ladder circuit portion 13, with the result that the impedances of the coaxial line 20 and the microstripline 10 having ladder circuit portion 13 are mismatched.

Some examples shown in FIG. 4 seq are directed to a particular structure for achieving impedance matching between the microstripline 10 and the coaxial line 20.

Referring to FIG. 4, a narrow portion 12*a* is formed in the center conductor 12 of the microstripline 10. The narrow portion 12*a* is formed to be tapered to become gradually narrower from the ladder circuit portion 13 to the junction 12*b*, i.e. the coaxial line 20. The width is set to be approximately 2 mm in the junction 12*b*. Since the narrow portion 12*a* is formed in the center conductor 12 and the same is tapered to become gradually narrower toward the junction to the coaxial line 20, the characteristic impedance of the microstripline 10 is increased, as is clear from the above described equation (2) so that the same may be approximately commensurate with the characteristic impedance of the coaxial line 20. Accordingly, a microwave can be efficiently supplied from the coaxial line 20 to the microstripline 10.

Figure 5:
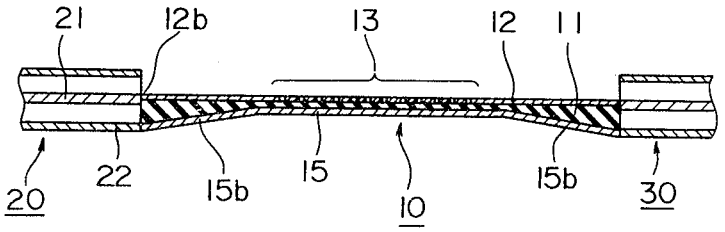
FIGS. 5 and 6 are sectional views showing a major portion of a further embodiment of the present invention.
Figure 6:
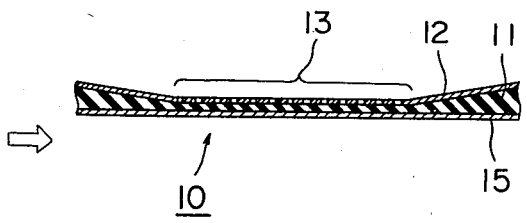

FIGS. 5 and 6 are sectional views showing a major portion of another embodiment of the present invention. The embodiments shown in FIGS. 5 and 6 are aimed to achieve impedance matching with the characteristic impedance of the coaxial line 20 by changing the thickness h of the dielectric base plate 11 in the above described equation (2) and by increasing the characteristic impedance of the microstripline 10. More specifically, in the case of the embodiments shown in FIGS. 5 and 6, the thickness of the dielectric base plate 11 is gradually increased in the microstripline 10 from the ladder circuit portion 13 toward the junction 12*b*. By gradually increasing the thickness of the dielectric base plate 11, the characteristic impedance at the input end of the microstripline 10 can be made to be approximately equal to that of the coaxial line 10. In the case of the FIG. 5 embodiment, the center conductor 12 of the microstripline 10 is maintained flat, while the thickness of the dielectric base plate 11 is changed such that the ground conductor 15 constitutes an inclined portion 15*b*. Conversely, in the case of the FIG. 6 embodiment, the thickness of the dielectric base plate 11 is changed such that the ground conductor 15 is maintained flat and the center conductor 12 may be inclined. By changing the thickness of the dielectric base plate 11 such that the ground conductor 15 may constitute the inclined portion 15*b* as in the case of the FIG. 5 embodiment, the inclined portion 15*b* performs a function of a ridge and accordingly the electric field strength of microwaves leaking from the ladder circuit portion 13 can be increased. The same applies to the FIG. 6 embodiment.

Figure 7:
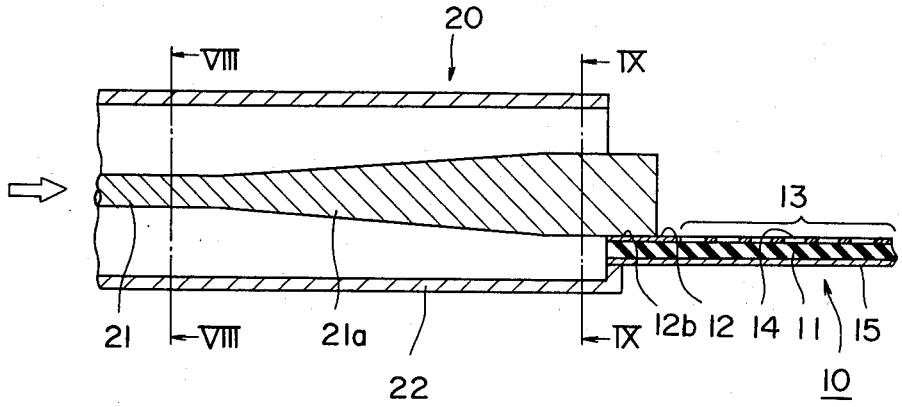
Figure 8:
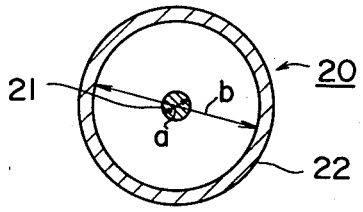
Figure 9:
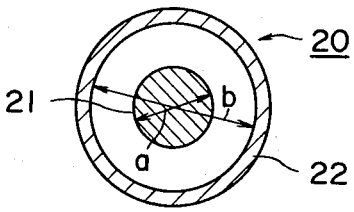

FIG. 7 is a sectional view showing another approach for eliminating inconveniences in the embodiments shown in FIGS. 4 to 6 and constitutes the background of the invention. More specifically, in the case where the characteristic impedance of the coaxial line 20 is maintained approximately 50Ω and the characteristic impedance at the junction of the microstripline 10 is approximated thereto or is made to be matched thereto, the length in the microwave propagating direction of the microstripline, i.e. the distance between the ladder circuit portion 13 and the junction 12*b* becomes large. Therefore, another approach can be considered in which a large diameter portion 21*a* is formed in the inner conductor 21 of the coaxial line 20, as shown in FIGS. 7 to 9. More specifically, the inner conductor 21 of the coaxial line 20 is adapted such that the diameter a thereof is different at the input and the output of the microwave, as shown in FIGS. 8 and 9 and the diameter at the output is selected to be larger than that in the input. Since impedance matching between both can be attained by not changing the characteristic impedance of the microstripline 10, if the above described approach is employed, the distance between the ladder circuit portion 13 of the microstripline 10 and the junction 12*b* is prevented from being undesirably elongated, as shown in FIG. 7. However, too large a diameter of the inner conductor 21 and thus too small a difference between the diameter of the inner conductor 21 and the inner diameter of the outer conductor 22 threatens to cause a spark between the inner conductor 21 and the outer conductor 22 due to microwave power.

Therefore, FIGS. 10 to 13 show embodiments having an impedance matching means provided on the part of the coaxial line without any fear of such spark.

Figure 10:
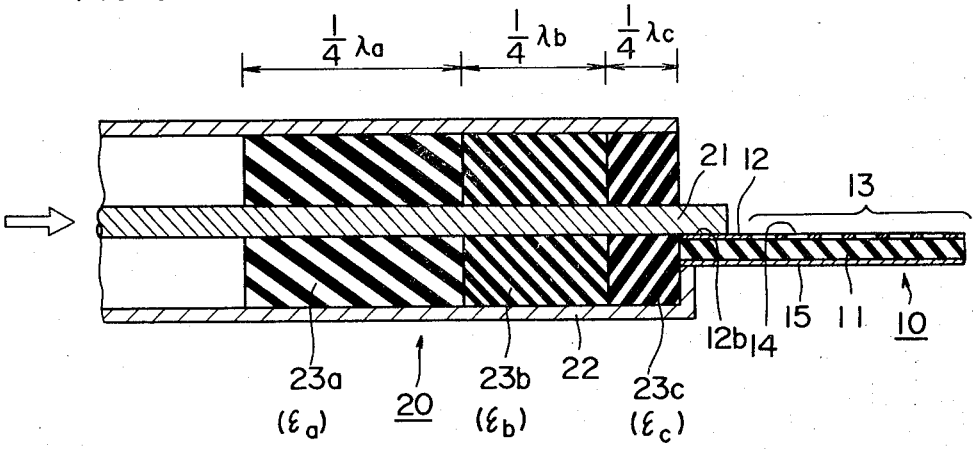
FIG. 10 is a sectional view of still a further embodiment of the present invention.

The FIG. 10 embodiment comprises dielectric materials 23*a*, 23*b* and 23*c* inserted at the output end of the coaxial line 20. The respective dielectric members 23*a*, 23*b* and 23*c* have different dielectric constants $\epsilon_a$, $\epsilon_b$ and $\epsilon_c$, respectively, in which these dielectric constants are selected to be in a relation of $\epsilon_a<\epsilon_b<\epsilon_c$. Generally, when different dielectric materials are laminated and a microwave is propagated in the laminating direction, a multiple reflection occurs in the lamination. However, if and when the thickness of the dielectric material, i.e. the length in the propagating direction of the microwave is selected to be a quarter of the effective wave length of the microwave being propagated, reflection from the respective lamination planes as described above is canceled, whereby undesired reflection is prevented from occurring. Therefore, in the FIG. 10 embodiment, the respective lengths of the dielectric members 23*a*, 23*b* and 23*c* are selected to be $\frac{1}{4}\lambda a$, $\frac{1}{4}\lambda b$ and $\frac{1}{4}\lambda c$, respectively. Meanwhile, λa, λb and λc each denote an effective wavelength of a microwave propagating through the dielectric material. Thus, by inserting a dielectric material between the inner conductor 21 and the outer conductor 22 of the coaxial line 20, the characteristic impedance Zo of the coaxial line 20 is decreased, as is appreciated from the above described equation (1). Accordingly, by properly selecting the dielectric constant of the dielectric material, the characteristic impedance of the coaxial line 20 can be smaller than the above described 50Ω and can be approximated to the characteristic impedance of the microstripline 10. According to the embodiment shown, even if the distance between the ladder circuit portion 13 and the junction 12*b* in the microstripline 10 is elongated, impedance matching with the coaxial line 20 can be easily attained. In addition, it is not necessary to change the diameter of the inner conductor 21 and accordingly an undesired spark is prevented from occurring between the inner conductor 21 and the outer conductor 22. Meanwhile, although a ceramic material such as alumina, titanium oxide, etc is preferred, any other type of dielectric material may be utilized.

Figure 11:
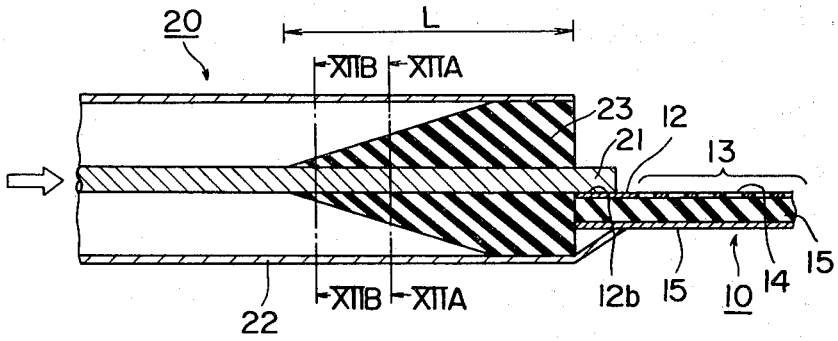
FIGS. 11, 12A and 12B are sectional views showing still a further embodiment of the present invention.
Figure 12A:
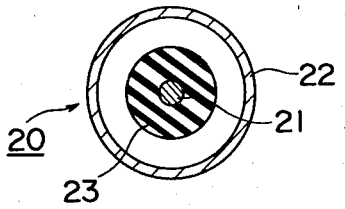
Figure 12B:
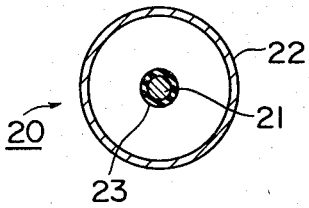

FIG. 11 is a sectional view showing a major portion of still a further embodiment of the present invention. Even in the case of the FIG. 11 embodiment, the dielectric member 23 is inserted between the inner conductor 21 and the outer conductor 22 at the output end of the coaxial line 20. The microwave input end surface 23*d* of the dielectric member 23 is formed in a conical shape such that the diameter is gradually increased in the propagating direction of the microwave with the inner conductor 21 as a center, as is clear from FIGS. 12A and 12B. In other words, the end surface 23*d* of the dielectric member 23 is formed to have a surface intersecting the inner conductor 21 of the coaxial line 20 at an acute angle. According to the FIG. 11 embodiment, microwaves fed from the microwave oscillator, not shown, are supplied to the microstripline 10 as a function of the end surface 23*d* without being reflected from the dielectric member 23 and hence with high efficiency. Even in the case of the embodiment shown, the impedance matching can be readily achieved by means of the dielectric member 23.

FIG. 13 is a sectional view showing still a further embodiment of the present invention. The FIG. 13 embodiment comprises a combination of the FIG. 7 embodiment and the FIG. 11 embodiment. More specifically, a large scale portion 21*a* is formed in the inner conductor 21 of the coaxial line 20 and a dielectric member 23 is filled in the coaxial line 20. By doing so, the length L of the dielectric member 23 can be shortened as compared with that of the FIG. 11 embodiment. The reason is that the effect of decreasing the characteristic impedance as a function of the large diameter portion 21*a* formed in the inner conductor 21 and a function of decreasing the characteristic impedance through insertion of the dielectric member 23 coact with each other. According to the FIG. 13 embodiment, even if a large diameter portion 21*a* is formed in the inner conductor 21, an undesired spark is prevented from occurring between the inner conductor 21 and the outer conductor 22 as a function of the dielectric member 23. Meanwhile, the inclining direction of the microwave entering end surface 23*d* of the dielectric member 23 shown in FIGS. 11 and 13 may be reversed to that shown as a matter of course.

FIGS. 14 and 15 are perspective views showing still a further embodiment of the present invention, wherein FIG. 14 is a plan view and FIG. 15 is a bottom view. As seen from the figures, the embodiment comprises a ladder circuit portion 13' formed at the ground conductor 15 of the microstripline 10, the center conductor 12 being formed in a constant width as in the case of the ordinary microstripline, as compared with the previously described embodiments. More specifically, as is different from the previously described embodiments, the embodiment shown in FIGS. 14 and 15 is formed with the slits 14' and thus the ladder circuit portion 13' at a portion or all of the ground conductor 15.

As is clear from the previously described equation (2), the characteristic impedance of the microstripline depends on the width c of the center conductor. The smaller the width c, the larger the characteristic impedance. Therefore, by making small the width of the center conductor 12 to be constant, as in the case of the embodiment, the characteristic impedance of the microstripline 10 is increased to be as large as approximately 50Ω as compared with a case where the width is increased by forming the ladder circuit portion 13 in the center conductor 12 as in the case of the previously described embodiments. On the other hand, the characteristic impedance of the coaxial line 20 is also approximately 50Ω, as described previously. Therefore, according to the embodiment shown, any particular structure or means for achieving impedance matching between the coaxial line 20 and the microstripline 10 could be dispensed with. For example, in the case of the previously described embodiments, the characteristic impedance of the microstripline 10 of the ladder circuit portion 13 is approximately 15Ω and that of the embodiment in discussion is approximately 50Ω.

On the other hand, it has been well-known that the characteristic impedance Zo of the microstripline 10 is $Zo=E/H$, where E is an electric field component and H is a magnetic field component. The microstripline of the above described characteristic impedance of approximately 50Ω exhibits a large electric field component (E), as compared with that of the charactertistic impedance of approximately 15Ω. Thus, the fact that the electric field component of the microwave being propagated is large means that the electric field component of the microwaves being leaked through the slits 14' of the ladder circuit portion 13' becomes accordingly large. Therefore, electric energy fed to the material being heated 40 such as a paper sheet is accordingly large. Thus, according to the embodiment shown in FIGS. 14 and 15 wherein the ladder circuit portion 13' is formed not in the center conductor 12 but in the ground conductor 15, a heating efficiency is enhanced. According to the experimentation conducted by the inventors, it was observed that microwave power required for supplying the same energy in the embodiment in discussion may be approximately one tenth of the microwave power required for supplying the same heating energy in any of the embodiments shown in FIGS. 2 to 13. Accordingly, it is intended that the present invention broadly covers a case where the ladder circuit portion 13 is formed in the center conductor 12 and a case where the ladder circuit portion 13' is formed in the ground conductor 15.

Figure 16:
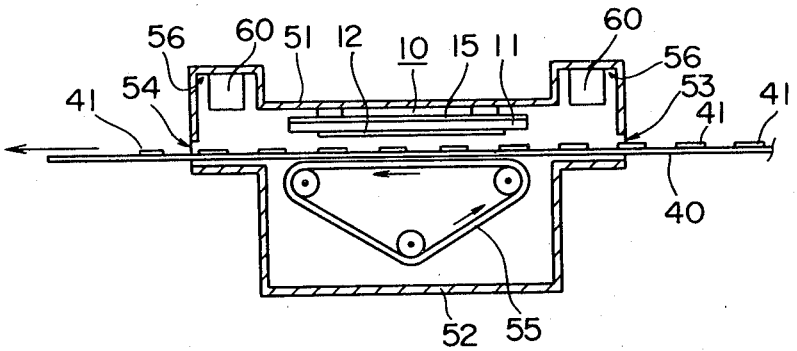
Figure 17:
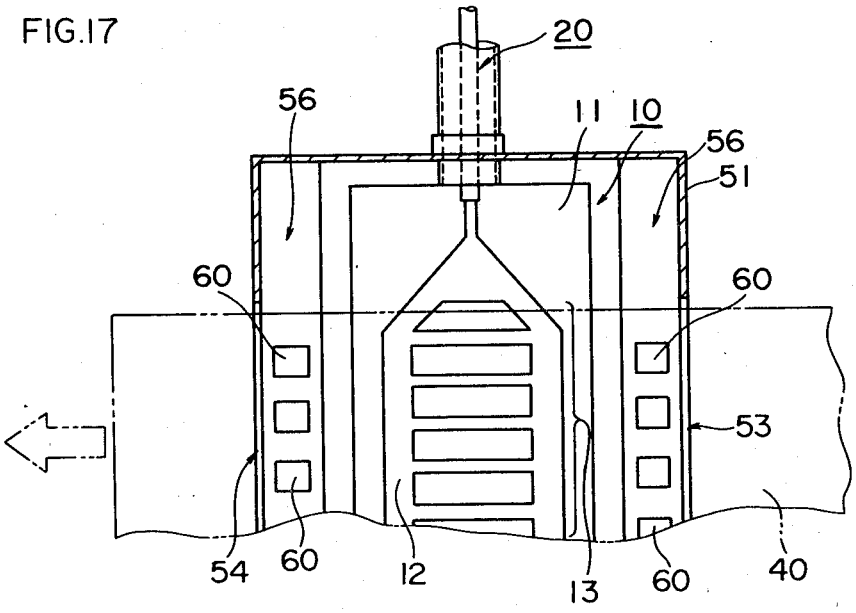
Figure 18:
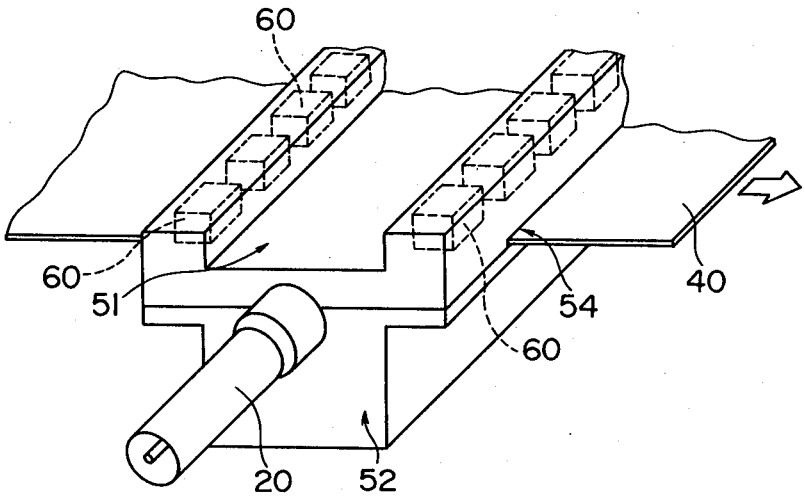

FIGS. 16 to 18 show a preferred embodiment of the present invention. The embodiment shown comprises an application of the heating apparatus employing the microstripline 10 as a toner fixing apparatus of an electrophotographic apparatus. The microstripline 10 is housed in a heating chamber and the heating chamber is formed with half shells 51 and 52. The half shells 52 are preferably made of an electrically good conductive material such as metal, electrically conductive plastic or the like in consideration of a shielding function. The half shell 51 houses and holds the microstripline 10 above a paper sheet 40 being transferred by means of a conveyor 55. The paper sheet 40 is carried into the inlet 53 of the heating chamber and is carried from the outlet 54. Transfer of the paper sheet 40 is carried out by the conveyor 55 housed in the half shell 52. In the case of the embodiment shown, toner layers 41 are adhered selectively on the surface of the paper sheet 40. Grooves 56 are formed at both ends of the half shell 51 in the transfer direction of the paper sheet 40. The grooves 56 extend in the direction orthogonal to the transfer direction of the paper sheet 40, i.e. in the propagaging direction of the microwave. A plurality of dielectric resonators 60 of the TE mode are housed and fixed in the grooves 56. These dielectric resonators 60 are provided to prevent leakage of the microwave outside the heating chamber and the resonance frequency and thus the geometry is selected to the optimum value in association with the frequency of the microwave leakage of which is to be prevented. Microwaves are supplied from the coaxial line 20 to the microstripline 10 in such structure. The paper sheet 40 with unfixed toner layers 41 adhered is transferred in succession from the inlet 53 to the outlet 54 by means of the conveyor 55. When the microwaves are thus supplied to the microstripline 10, the microwaves leaking through the ladder circuit portion 13 heat the paper 40 and the toner layers 41. The heated toner layers 41 are melted and fixed to the paper sheet 40. The microwaves leaked through the ladder circuit portion 13 would leak through the inlet 53 and/or the outlet 54 of the heating chamber; however, the same are trapped by means of the dielectric resonators 60 of the TE mode arranged in the vicinity thereof and accordingly there is no fear that the microwaves are leaked through the normally opened inlet 53 and/or the outlet 54. Although provision of a so-called choke cavity is known as another approach for the purpose of preventing leakage of microwaves, employment of a plurality of dielectric resonators 60 of the TE mode as in the case of the embodiment shown enables leakage prevention implementation in a very small size as compared with a case where a choke cavity is employed, which, together with a small sized implementation due to employment of the microstripline 10, further enables an implementation of the apparatus as a whole in a small size. Meanwhile, it is needless to say that any of the embodiments shown in FIGS. 2 to 15 can be applied to the FIG. 16 embodiment.

Figure 19:
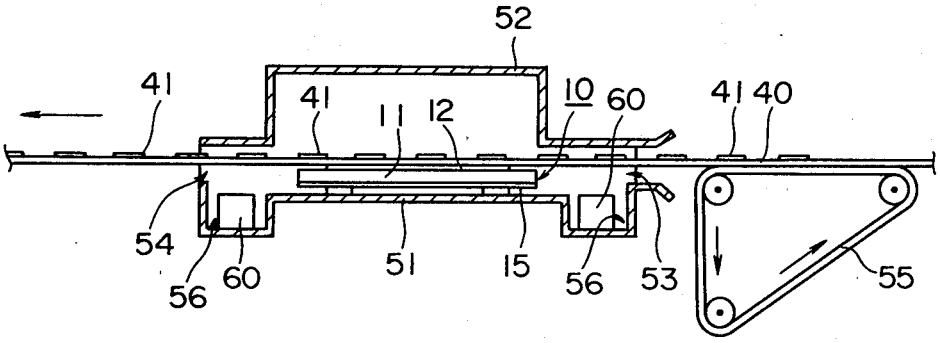
FIG. 19 is a view showing a modification of the FIG. 16 embodiment.

FIG. 19 is a modification of the FIG. 16 embodiment. More specifically, in the FIG. 19 embodiment, the microstripline 10 is provided below the paper sheet 40 being transferred and accordingly a plurality of dielectric resonators 60 are also provided below the paper sheet 40 in the vicinity of the inlet 53 and the outlet 54. The conveyor 55 is provided outside the heating chamber. The other portion of the structure and the effect of preventing leakage of the microwave are the same as those of the previously described FIG. 16 embodiment.

Meanwhile, in the foregoing the preferred embodiments were described as employing the inventive microwave heating apparatus as a heating apparatus of an electrophotographic apparatus. However, it is a matter of course that the present invention can be applied with any suitable modifications in order to uniformly heat the whole portion of a sheet-like material or to uniformly heat the surface of a material having a given thickness. By way of one example, the present invention could be advantageously utilized in a process for curing rubber, for example.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave heating apparatus for heating sheet-like materials, comprising:

first microstripline means having a center conductor and at least one ground conductor having a dielectric layer therebetween, at least one of said center conductor and said ground conductor including a ladder delay circuit portion, microwave supply means for supplying a microwave to said microstripline means, and means for bringing a material to be heated to the vicinity of said ladder delay circuit portion.

2. A microwave heating apparatus in accordance with claim 1, wherein said microwave supply means comprises second microstripline means, said second microstripline means being coupled to said first microstripline means.

3. A microwave heating apparatus in accordance with claims 2, which further comprises impedance matching means for achieving impedance matching between said first and second microstripline means.

4. A microwave heating apparatus in accordance with claim 1, wherein said microwave supply means comprises coaxial line means having an inner conductor and an outer conductor coupled to said first microstripline means.

5. A microwave heating apparatus in accordance with claim 4, wherein said center conductor of said first microstripline means is connected to the inner conductor of said coaxial line means and the ground conductor of said microstripline means is connected to the outer conductor of said coaxial line means.

6. A microwave heating apparatus in accordance with claim 4, wherein said center conductor of said first microstripline means is connected to the outer conductor of said coaxial line means and the ground conductor of said microstripline means is connected to the inner conductor of said coaxial line means.

7. A microwave heating apparatus in accordance with claim 4, which further comprises impedance matching means for achieving impedance matching between said first microstripline means and said coaxial line means.

8. A microwave heating apparatus in accordance with claim 7, wherein said impedance matching means is provided on the part of said first microstripline means.

9. A microwave heating apparatus in accordance with claim 8, wherein said impedance matching means comprises a narrow portion formed in at least one of said center conductor and said one ground conductor of said microstripline means, and said narrow portion is formed to be narrower than said delay ladder circuit portion at the side connected to said coaxial line means.

10. A microwave heating apparatus in accordance with claim 9, wherein said narrow portion is formed to be gradually narrower from said delay ladder circuit portion toward said coaxial line means.

11. A microwave heating apparatus in accordance with claim 8, wherein said impedance matching means comprises a dielectric layer inserted between said center conductor and said ground conductor, and said dielectric layer having an increased thickness portion where the thickness thereof is gradually increased from said ladder circuit portion toward said coaxial line means.

12. A microwave heating apparatus in accordance with claim 11, wherein said increased thickness portion of said dielectric layer is formed such that said center conductor of said microstripline first means is maintained flat while said ground conductor is inclined as per the change of said thickness.

13. A microwave heating apparatus in accordance with claim 11, wherein said increased thickness portion of said dielectric layer is formed such that said ground conductor of said microstripline means is maintained flat while said center conductor is inclined as per the change of said thickness.

14. A microwave heating apparatus in accordance with claim 7, wherein said impedance matching means is formed on the part of said coaxial line means.

15. A microwave heating apparatus in accordance with claim 14, wherein said coaxial line means comprises a dielectric layer inserted between said inner conductor and said outer conductor at the junction between said coaxial line means and said first microstripline means.

16. A microwave heating apparatus in accordance with claim 15, wherein the dielectric constant of said dielectric layer is selected such that the characteristic impedance of said coaxial line means is matched to the characteristic impedance of said first microstripline means.

17. A microwave heating apparatus in accordance with claim 16, wherein the length of said dielectric layer is selected to be a quarter of the effective wavelength of the microwave being utilized.

18. A microwave heating apparatus in accordance with any of the preceding claims 15 to 17, wherein said dielectric layer comprises two or more portions sectioned in the length direction, each portion having a different dielectric constant, the dielectric constant of each said different portion of said dielectric layer being selected such that the dielectric constant of the portion coupled to said first microstripline means is larger than that of the other portion.

19. A microwave heating apparatus in accordance with claim 15, wherein said dielectric layer has an end surface intersecting the axis of said coaxial line means at an acute angle at the input side of the microwave.

20. A microwave heating apparatus in accordance with claim 19, wherein said inner conductor of said coaxial line means comprises an increased diameter portion formed at the junction between said coaxial line means and said first microstripline means.

21. A microwave heating apparatus in accordance with claim 20, wherein said increased diameter portion is formed such that the diameter is gradually increased toward the junction between said coaxial line means and said first microstripline means.

22. A microwave heating appartus in accordance with claim 1, which further comprises a heating chamber having an inlet and an outlet and being provided in association with said ladder circuit portion, said material being heated being carried in said inlet and carried from said outlet, and microwave leakage preventing means provided in said heating chamber in association with at least one of said inlet and said outlet.

23. A microwave heating apparatus in accordance with claim 22, wherein said leakage preventing means comprises a plurality of dielectric resonators of the TE mode, the resonance frequency of the respective dielectric resonators being selected in association with the effective wavelength of the microwave leakage of which is to be prevented.

24. A microwave heating apparatus in accordance with claim 22 or 23, wherein said heating chamber is made of an electrically conductive material.

25. A microwave heating apparatus, comprising:

a microstripline means including a center conductor and a ground conductor;

a slot radiator portion having a plurality of slots formed on said ground conductor;

means for supplying a microwave to said microstripline means; and means for bringing a material to be heated to the vicinity of said slot radiator portion.

* * * * *